US009227305B2

(12) United States Patent
Scarpuzzi

(10) Patent No.: US 9,227,305 B2
(45) Date of Patent: Jan. 5, 2016

(54) APPARATUS AND RELATED METHODS FOR STOPPING WATER FLOW FROM FIRE SPRINKLERS

(71) Applicant: Matthew Scarpuzzi, La Jolla, CA (US)

(72) Inventor: Matthew Scarpuzzi, La Jolla, CA (US)

( * ) Notice: Subject to any disclaimer, the term of this patent is extended or adjusted under 35 U.S.C. 154(b) by 272 days.

(21) Appl. No.: 13/924,400

(22) Filed: Jun. 21, 2013

(65) Prior Publication Data

US 2014/0373688 A1 Dec. 25, 2014

Related U.S. Application Data

(60) Provisional application No. 61/853,856, filed on Apr. 15, 2013.

(51) Int. Cl.

| | |
|---|---|
| ***B25B 7/20*** | (2006.01) |
| ***A62C 35/68*** | (2006.01) |
| ***A62C 37/20*** | (2006.01) |
| ***B25B 7/02*** | (2006.01) |
| ***B25B 7/14*** | (2006.01) |
| ***A62C 37/12*** | (2006.01) |
| ***B25B 7/12*** | (2006.01) |
| ***B25B 27/10*** | (2006.01) |

(52) U.S. Cl.

CPC . *B25B 7/20* (2013.01); *A62C 35/68* (2013.01); *A62C 37/12* (2013.01); *A62C 37/20* (2013.01); *B25B 7/02* (2013.01); *B25B 7/12* (2013.01); *B25B 7/14* (2013.01); *B25B 27/10* (2013.01); *Y10T 29/49826* (2015.01)

(58) Field of Classification Search

CPC ..... B25B 7/20; B25B 7/02; B25B 7/14; B25B 7/12; B25B 27/10; A62C 35/68; A62C 37/20; A62C 37/21; A62C 37/11; A62C 37/12; A62C 37/16; Y10T 29/49826

USPC ..... 81/418–420; 169/90, 41

See application file for complete search history.

(56) References Cited

U.S. PATENT DOCUMENTS

| | | | | |
|---|---|---|---|---|
| 1,028,247 | A * | 6/1912 | Morey | 169/90 |
| 1,189,820 | A * | 7/1916 | Holmes et al. | 169/90 |
| 2,743,782 | A * | 5/1956 | Occhipinti | A62C 37/20 169/39 |
| 3,550,687 | A * | 12/1970 | Thaxton | 169/90 |

(Continued)

FOREIGN PATENT DOCUMENTS

| | | |
|---|---|---|
| JP | 61-057952 | 4/1986 |
| JP | 2000-042131 | 2/2000 |

(Continued)

*Primary Examiner* — Hadi Shakeri

(74) *Attorney, Agent, or Firm* — Buche & Associates, P.C.; John K. Buche

(57) ABSTRACT

Disclosed are an apparatus and related methods for quickly deactivating or otherwise plugging a sprinkler, wherein the deactivated sprinkler may automatically reactivate in view of an unexpected fire. Generally, the disclosed apparatus comprises: a forked clamping arm and a jaw arm with a stopper plug, wherein the forked clamping arm is positioned around a body of a fire-sprinkler and the plug is squeezed against an outlet of a fire-sprinkler via locking plier action between the clamping arm member and the jaw arm member. Suitably, a water tight seal is created by the plug over the outlet. Preferably, the plug of the apparatus may be configured to melt whenever ambient temperatures surrounding the sprinkler reach a threshold level so that the sprinkler may reactivate in view of an unexpected fire in its proximity.

1 Claim, 6 Drawing Sheets

(56) References Cited

U.S. PATENT DOCUMENTS 3,715,794 A * 2/1973 McCollum ..... B25B 27/0035 29/235
4,467,512 A * 8/1984 Modes ..... B25B 7/12 29/237
4,616,710 A * 10/1986 Pilant et al. ..... 169/41
6,487,942 B1 * 12/2002 Carter ..... A62C 31/28 81/367
8,875,742 B2 * 11/2014 Liao ..... F16B 2/10 138/89
8,973,673 B2 * 3/2015 Patterson et al. ..... 169/90
2011/0120737 A1 5/2011 Flynn

FOREIGN PATENT DOCUMENTS

JP 2008-264021 11/2008
JP 2011-120699 6/2011

* cited by examiner

APPARATUS AND RELATED METHODS FOR STOPPING WATER FLOW FROM FIRE SPRINKLERS

CROSS-REFERENCE TO RELATED APPLICATIONS

This application claims the benefit and priority of U.S. Prov. App. Ser. No. 61/853,856 (filed Apr. 15, 2013) entitled "Apparatus and related methods for controlling activated fire sprinkler head."

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not applicable.

BACKGROUND OF THE INVENTION

1. Field of Invention

This invention relates to apparatus and related methods for blocking the flow of water from a broken or activated fire sprinkler.

2. Description of Related Art

Fire sprinkler systems are occasionally placed in buildings for fighting unexpected or out of control fires. The individual sprinklers within the system generally feature a plugged nozzle that is (a) located at the end of a fluid filled or fluid fed pipe and (b) directed toward a deflector plate. Typically, the plug in the nozzle is configured to give way to the fluid whenever the same is heated beyond a threshold temperature. See, e.g., U.S. Pat. No. 4,616,710 (issued Oct. 14, 1986); see also vials filled with heat-expanding fluids which rupture when heated to a threshold temperature. While a sprinkler nozzle is unplugged, a condition known colloquially as "activated," the fluid flows from the sprinkler and is deflected by the deflector plate over an area within the building until the pipe is either drained of fluid, the fluid feed is shut-off, or the nozzle is re-plugged. Sprinklers are typically coupled to water piping with one half inch male national pipe thread (NPT) or three quarters inch male NPT for high volume water flows. Many buildings have a combination of different sized, and sometimes differently shaped, sprinklers.

For fluid filled sprinkler systems, occasions arise wherein plugging the accidentally activated nozzle is more preferable than draining the pipe or shutting-off the fluid feed. For example, plugging an accidentally activated nozzle is preferred to draining the pipe because, otherwise, the fluid is unnecessarily wasted or causes damage. Furthermore, plugging an activated nozzle is also preferred to draining the pipe whenever either: (1) all the fluid is not necessary to extinguish a fire because water is otherwise wasted; or (b) historic pipe conditions (e.g., rust, bacteria, mold and the like) or chemical additives have rendered toxic the fluid since the toxic fluid can cause damage to humans and environments proximate to the sprinkler system.

For fluid fed sprinkler systems, circumstances arise wherein plugging activated nozzles is more preferable than shutting-off the fluid feed of the system. Like fluid filled systems, fluid fed sprinkler systems should be plugged whenever its sprinklers are either activated accidentally or contain toxic fluid to avoid wasted fluid or fluid damage. Plugging an activated sprinkler in a fluid fed system is usually preferred to shutting-off the fluid feed to the pipe whenever shutting-off the fluid feed: is an expensive or difficult undertaking; results in no mechanisms for firefighting while the feed is shut-off (i.e., the building is at risk because there is no fire prevention mechanism); or expensive or difficult to turn back on.

In view of the foregoing, a need exists for mechanisms which are capable of deactivating or otherwise plugging a sprinkler. Apparatus and related methods have been developed to meet said need. Yet, until now none of said apparatus and methods have completely met said need.

Wedge apparatus are known which are configured to plug a sprinkler nozzle whenever positioned between the deflector plate and nozzle. See, e.g., U.S. Pat. No. 845,918 (issued Mar. 5, 1907), U.S. Pat. No. 2,700,423 (issued Jan. 25, 1955), and, U.S. Pub. Pat. App. No. 2008/0083544 (published Apr. 10, 2008). Although useful for quickly deactivating sprinklers, wedge apparatus are not entirely satisfactory for all circumstances. One unsatisfactory aspect of a wedge apparatus is that the interface between the wedge and the nozzle is not always water tight because of the wedge incline. Another unsatisfactory aspect of a wedge apparatus is that the wedge must be manually removed with the result being that the sprinkler cannot automatically activate in view of an unexpected fire.

Capping apparatus are further known for deactivating sprinkler nozzles. See e.g., U.S. Pat. No. 2,986,242 (issued May 23, 1961), U.S. Pat. No. 4,676,320 (issued Jan. 30, 1987), U.S. Pat. No. 4,830,117 (issued May 16, 1989), U.S. Pat. No. 6,487,942 (issued Dec. 3, 2002). While capping apparatus are capable of plugging a sprinkler nozzle, capping apparatus cannot ordinarily be universally applied to all sprinklers. Also, like the wedge and lift apparatus, capping apparatus must be manually removed and, as a result, the sprinkler cannot automatically activate in view of an unexpected fire.

Balloon apparatus are known which are configured to expand between the deflector plate and nozzle opening whereby the expansion plugs the nozzle. See, e.g., U.S. Pat. No. 7,025,285 (issued Apr. 11, 2006). Balloon apparatus can be useful for quickly deactivating a sprinkler. However, balloon apparatus require a substantial amount of compressed air to accomplish deactivation of a sprinkler nozzle. Furthermore, compressed air sources are not always available. Accordingly, balloon apparatus are not satisfactory for deactivating sprinklers in all circumstances.

Lift apparatus (whether by spring or screw operations) are also known for deactivating sprinklers, wherein a lower portion of the device is positioned against the deflector plate and an upper portion of the device is raised into plugging interface with the nozzle. See, e.g., U.S. Pat. No. 2,417,265 (issued Mar. 11, 1947), U.S. Pat. No. 2,520,588 (issued Aug. 29, 1950), U.S. Pat. No. 2,743,782 (issued May 1, 1956), U.S. Pat. No. 3,191,685 (issued Jun. 29, 1965), U.S. Pat. No. 3,223,171 (issued Dec. 14, 1965) U.S. Pat. No. 3,550,687 (issued Dec. 29, 1970), U.S. Pat. No. 3,976,141 (issued Aug. 24, 1976), U.S. Pat. No. 4,638,866 (issued Jan. 27, 1987), U.S. Pat. No. 5,560,430 (issued Oct. 1, 1996), U.S. Pat. No.

6,575,252 (issued Jun. 10, 2003), U.S. Pat. No. 7,743,838 (issued Jun. 29, 2010), and U.S. Pub. Pat. No. 2006/0042803 (published Mar. 2, 2006). Lift apparatus are sometimes unsatisfactory for deactivating sprinklers because such apparatus require careful, tedious, or difficult positioning and manipulation of the lift to plug the nozzle in a fluid tight manner. Frequently, installation of a lift apparatus involves extended exposure to toxic sprinkler discharge or the unsafe practice of climbing a wet ladder to reach the sprinkler. Lift apparatus are also unsatisfactory because the same do not accommodate different volume sprinkler heads. That is to say, lift apparatus are not typically configured for stopping both sprinklers for one half inch NPT and sprinklers for three quarters inch NPT. This means that multiple versions of a lift apparatus must be used depending on the sprinkler system. Additionally, lift apparatus, like wedge apparatus, must be manually removed from a sprinkler with a consequence that the sprinkler cannot automatically activate in view of an unexpected fire.

Finally, wedge, lift, capping, and balloon apparatus are not capable of plugging sheared or otherwise severely damaged sprinklers.

In view of the foregoing, a need still exists for apparatus and related methods of deactivating a sprinkler without the drawbacks or shortcomings of known apparatus for the same purpose.

SUMMARY OF THE INVENTION

Disclosed are an apparatus and related methods for quickly deactivating or otherwise plugging a sprinkler, wherein the deactivated sprinkler may automatically reactivate in view of an unexpected fire. Further disclosed is an apparatus that may be used to stop water flow from sprinklers of different sized NPT. Generally, the disclosed apparatus comprises: a forked clamping arm at the end of a body handle member; a jaw arm with a stopper plug, said jaw arm pivotally mounted to the body handle member; a lever handle member that is pivotally coupled to the jaw arm and mechanically coupled to the body handle member via a strut member; wherein moving the lever handle member toward the body handle member correspondingly moves from on the jaw arm so that the stopper plug is directed toward a recess of the forked clamping arm; and, a locking mechanism for locking the jaw arm in a position with respect to the clamping arm. In one mode of operation, the recess of the forked clamper arm may be positioned around a body of a fire-sprinkler so that the stopper plug of the jaw arm may be directed toward the outlet of the sprinkler head via manipulation of the handle and lever arm members. Suitably, the jaw and clamping members may be locked so that the stopper plug is squeezed between the outlet of the sprinkler and the jaw arm so that a water tight seal is created. Suitably, the plug of the apparatus may be configured to melt whenever ambient temperatures surrounding the sprinkler reach a threshold level so that the apparatus releases from the sprinkler so that the sprinkler may reactivate in view of an unexpected fire in its proximity.

BRIEF DESCRIPTION OF THE FIGURES

Other objectives of the disclosure will become apparent to those skilled in the art once the invention has been shown and described. The manner in which these objectives and other desirable characteristics can be obtained is explained in the following description and attached figures in which.

In the figures, the reference numerals are as follows.

1000, a preferred fire sprinkler stopper apparatus;
1100, a clamping arm;
1110, a fork;
1111, a recess for receiving a portion of a fire sprinkler body;
1112, a reduction in recess size;
1120, a pin for securing the clamping arm 1100 to a body handle member 1300;
1200, a jaw arm;
1210, a stopper platform;
1211, a plug for stopping flow from a fire sprinkler head;
1220, a pin for securing the jaw arm 1200 to a lever handle member 1400;
1230, a pin for securing the jaw arm 1200 to the body handle member 1300
1300, the body handle member;
1310, a screw member;
1400, the lever handle member;
1410, a release lever;
1500, a strut member; and,
1510, a pin for securing the strut member 1500 to the lever handle member 1400.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed are an apparatus and related methods for quickly deactivating or otherwise plugging a sprinkler, wherein the deactivated sprinkler may automatically reactivate in view of an unexpected fire. Generally, the disclosed apparatus comprises: a forked clamping arm and a jaw arm with a stopper plug, wherein the forked clamping arm is positioned around a body of a fire-sprinkler and the plug is squeezed against an outlet of a fire-sprinkler via locking plier action between the clamping arm member and the jaw arm member. Suitably, a water tight seal is created by the plug over the outlet. Preferably, the plug of the apparatus may be configured to melt whenever ambient temperatures surrounding the sprinkler reach a threshold level so that the sprinkler may reactivate in view of an unexpected fire in its proximity.

Figure 1:
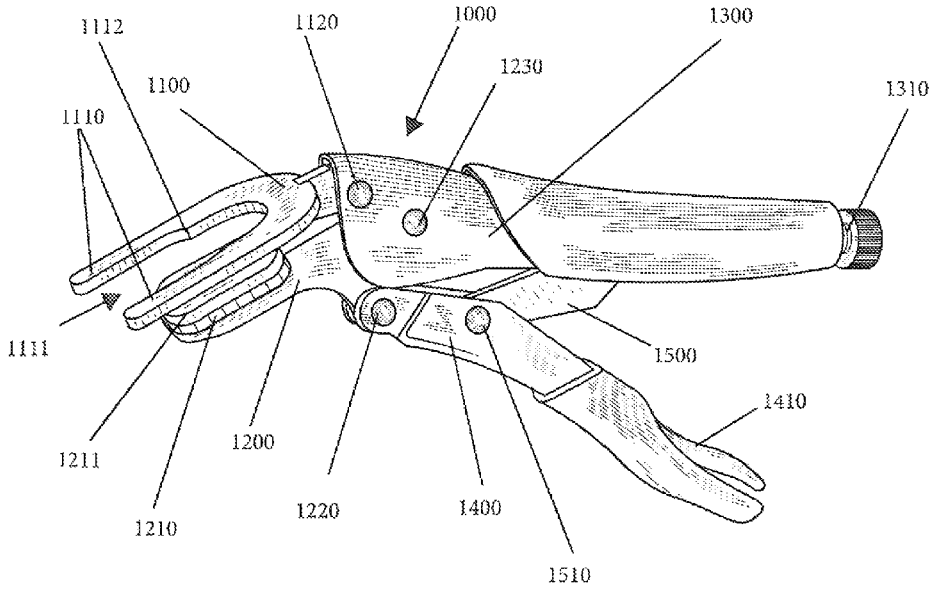
FIG. 1 is a perspective view of a preferred embodiment of a firesprinkler stopper apparatus 1000.
Figure 2:
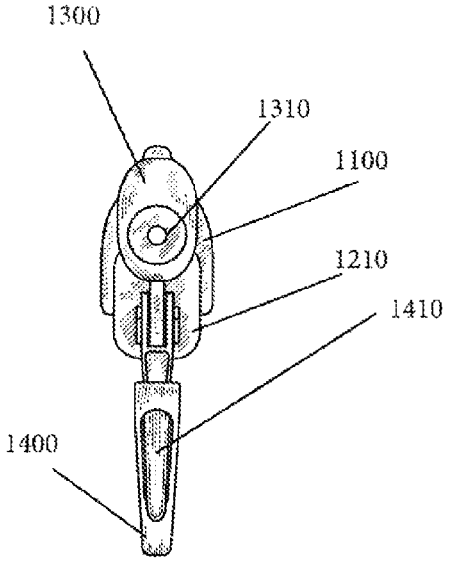
FIG. 2 is a back view of the apparatus 1000 of FIG. 1.
Figure 3:
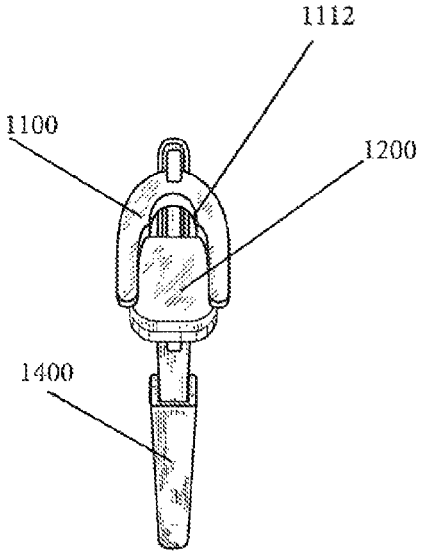
FIG. 3 is a front view of the apparatus 1000 of FIGS. 1 and 2.
Figure 4:
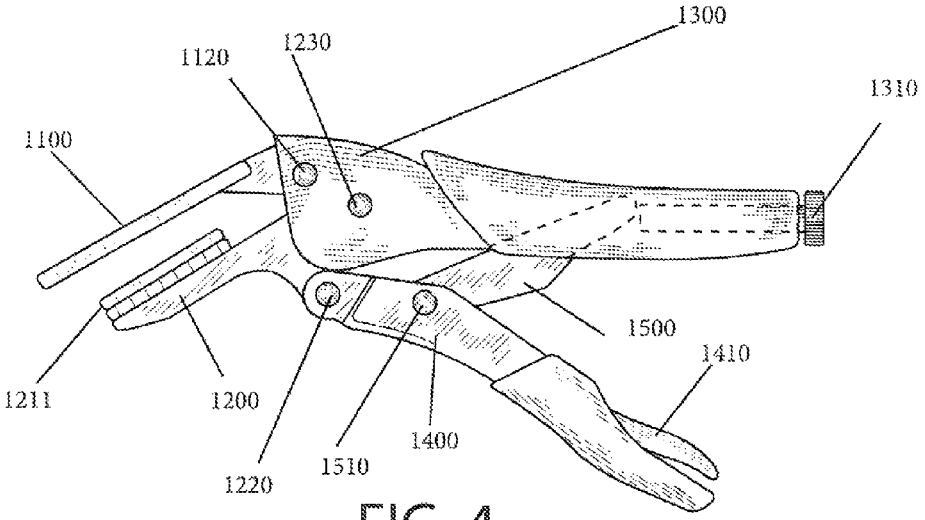
FIG. 4 is a left-side view of the apparatus 1000 of FIGS. 1 through 3.
Figure 5:
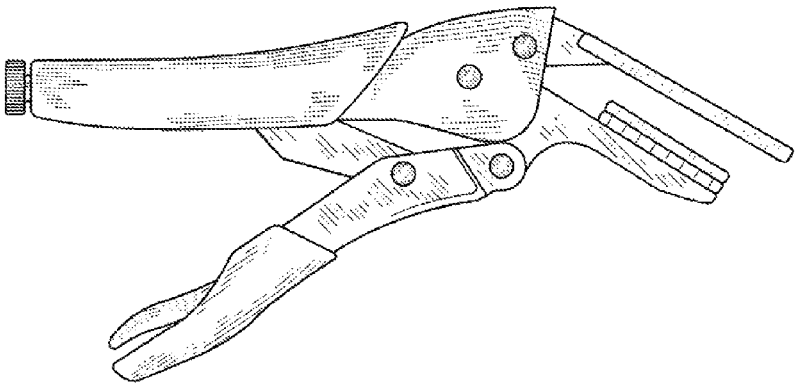
FIG. 5 is a right-side view of the apparatus 1000 of FIGS. 1 through 4.
Figure 6:
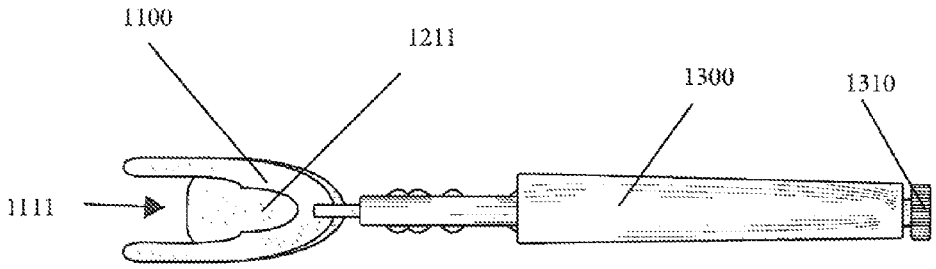
FIG. 6 is a top view of the apparatus of FIGS. 1 through 5.
Figure 7:
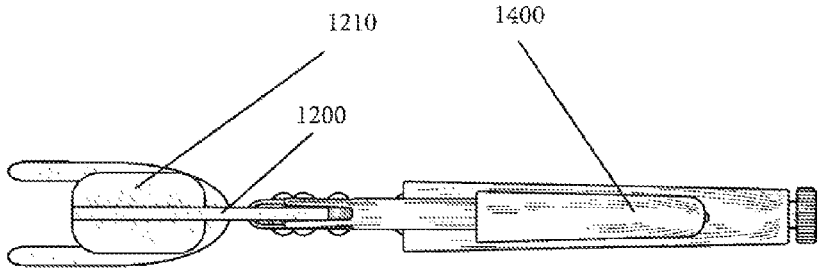
FIG. 7 is a bottom view of the apparatus of FIGS. 1 through 6.

FIG. 1 is a perspective view of a preferred embodiment of a fire sprinkler stopper apparatus 1000. FIGS. 2 through 7 are respectively a back view, a front view, a left-side view, a right-side view, a top view, a bottom view of the apparatus 1000 of FIG. 1. Referring to those figures, the apparatus 1000 comprises: a clamping arm 1100; a jaw arm 1200; a body handle member 1300; a lever handle member; and, a strut member. Suitably, the clamping arm 1100 is coupled to a front, top portion of the body handle member via a pin 1120 and obliquely extends therefrom said body handle member 1300. The jaw arm 1200 is preferably pivotally connected to (1) another front portion of the body handle member via another pin 1230; and (2) a front portion of the lever handle member 1400 via yet another pin 1220. Suitably, the handle members 1300, 1400 are pivotally connected to each other in view of their interconnection with the jaw arm 1200.

Still referring to FIGS. 1 through 7, the strut member 1500 is pivotally coupled at one of its 1500 ends to a mid-point of the lever handle 1400 via yet still another pin 1510. The opposite end of the strut member 1500 is received within the body handle 1300 and rests atop a screw 1310, which is threadably received through the butt of the body handle member 1300 (see FIG. 4). When the body handle member 1300 is moved towards the lever handle 1400, or vice versa, the strut member 1500 causes the upper end of the lever handle member 1400 to move upwardly and outwardly, thereby causing the jaw arm 1200 to pivot about the pin 1230 in the handle arm member 1300 and move toward the clamping arm 1100. By rotating the screw in a clockwise direction the portion of the screw within body handle member 1300 is lengthened to cause the jaw arm 1200 to be located closer to the clamping arm when the handle members 1300, 1400 are in a closed position. Suitably, rotating screw 1310 in the opposite direction has the opposite effect.

Still referring to the same figures, the handle members 1300, 1400 are preferably adapted to lock in their closed position when the centerline of lever handle member 1400 passes over the centerline of strut member 1500. This type of handle member operation is well known in locking pliers. For example, see, e.g., U.S. Pat. No. 3,747,392 (issued Jul. 24, 1973), U.S. Pat. No. 4,541,312 (issued Sep. 17, 1985), U.S. Pat. No. 5,050,466 (issued Sep. 24, 1991), U.S. Pat. No. 5,222,386 (issued Jun. 29, 1993), U.S. Pat. No. 5,351,585 (issued Oct. 4, 1994), U.S. Pat. No. 8,028,560 (issued Oct. 4, 2011), U.S. Des. Pat. No. D355,825 (issued Feb. 28, 1995) and U.S. Pub. No. 2012/0216657 (published Aug. 30, 2012). In a preferred embodiment, a release lever 1410 is provided to the lever handle member 1400 for prying the handle member 1400 away from a center locked engagement with strut member 1500.

Figure 8:
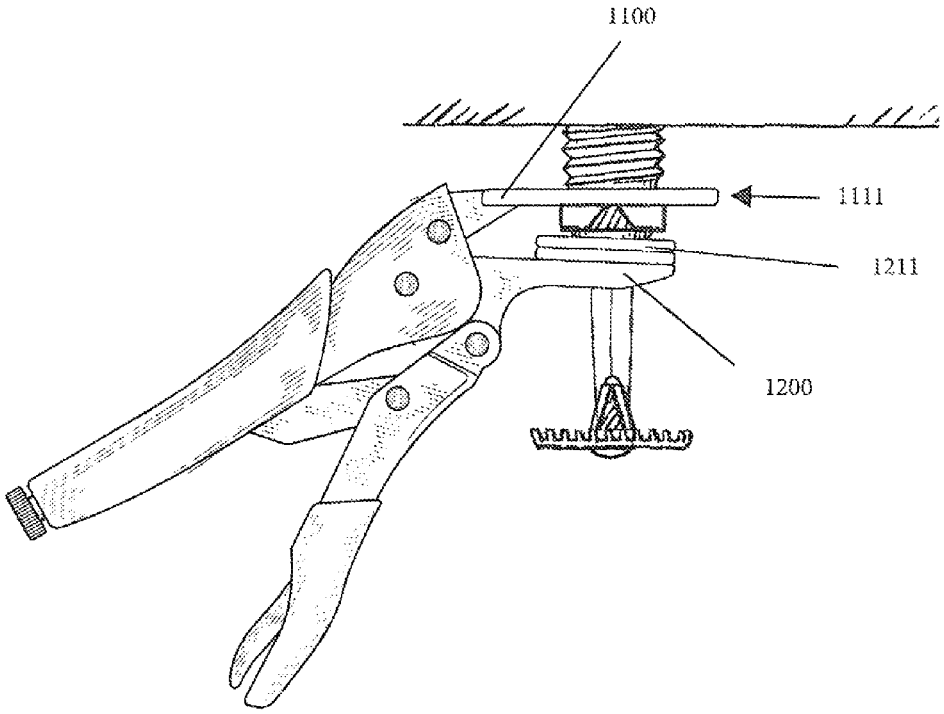
FIG. 8 is an environmental view of the apparatus of FIGS. 1 through 7.
Figure 9:
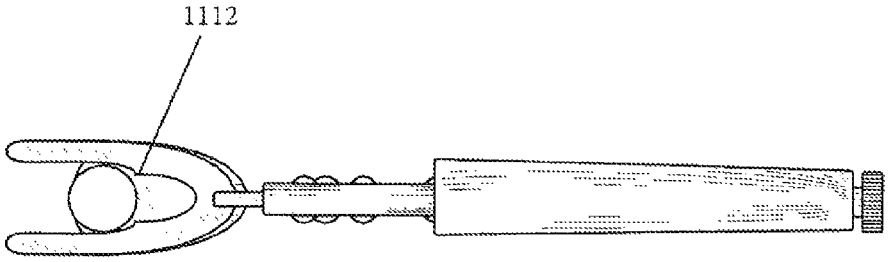
FIG. 9 is a contextual view of the apparatus 1000 of FIGS. 1 through 8; and, FIG. 10 is another contextual view of the apparatus 1000 of FIGS. 1 through 8.
Figure 10:
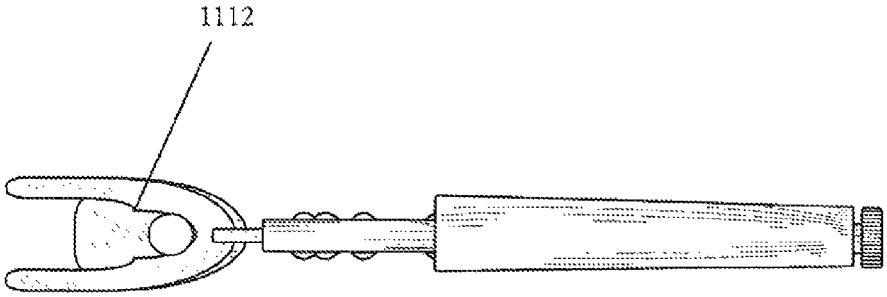

FIG. 8 is an environmental view of the apparatus of FIGS. 1 through 7. FIGS. 9 and 10 are contextual views of the apparatus 1000 shown in FIG. 8. Referring to those figures, the clamping arm 1100 is forked. Specifically, the clamping arm 1100 is defined on one end by a fork 1110 with a recess 1111. Preferably, the recess 1111 may be used to receive the threaded portion of a sprinkler head to engage with the sprinkler. Referring to FIG. 8, as the fork of the clamping arm 1100 engages with the sprinkler the plug 1211 of the jaw arm 1200 comes near the orifice of the sprinkler head. Suitably, the screw 1310 is positioned such that, when the handle members are locked relative to one another, the plug 1211 is squeezed against the orifice of the sprinkler head so that a water tight seal is created. Referring to FIGS. 9 and 10, the plug 1211 is preferably ovular so that the plug 1211 may interact with a sprinkler orifice regardless of whether the orifice and plug are exactly aligned. For further alignment correction, the plug 1211 is three-sixteenth inch Buna Rubber (Shore A) which is designed for displacement whereby a seal may be created regardless of whether the sprinkler nozzle is aligned with the jaw arm 1200. In one embodiment, the apparatus 1000 may be placed at the end of a telescoping pole and coupled to a high-overhead sprinkler by locking plier action. In another embodiment, the fork 1110 is bent downward at its tips to facilitate sliding of the device along a ceiling for placement around a sprinkler.

Referring to FIGS. 9 and 10, the fork 1110 of the clamping arm 1100 features a recess that is adapted to receive sprinklers for one half inch NPT and sprinklers for three quarters inch NPT. As shown in said figures, the recess 1111 features a reduction in size 1112. As shown in FIG. 9, the wider part of the fork 1110 is adapted to receive sprinklers for piping with three-quarters inch NPT. As shown in FIG. 10, the narrower part of the fork 1110 is adapted to receive sprinklers for piping of one half inch NPT.

In one embodiment, the apparatus 1000 may be designed to be locked onto an active sprinkler as a means for extended sprinkler deactivation. Suitably, the apparatus 1000 may be configured with a rubber plug 1210 which includes a fusible material that melts away when heated beyond a threshold temperature (see, e.g., U.S. Pat. No. 4,616,710 (issued Oct. 14, 1986)). In one embodiment the plug is a high temperature relief plug of wax, wherein the wax melts when heated beyond a threshold temperature so that the plug over the sprinkler nozzle no longer becomes fluid tight (see FIG. 8). In the present embodiment, said configuration of the apparatus 1000 allows its release from a fire sprinkler in view of an unexpected fire in the sprinkler's proximity.

This specification and the appended figures illustrate only typical embodiments or principles disclosed in this application, and therefore, are not to be considered limiting of its scope, for the invention may admit to other equally effective embodiments that will be appreciated by those reasonably skilled in the relevant arts. For instance: the drawings show the tip 100 configured with a particular size, shape and angle, but it will be appreciated by those in the art that different positions and shapes may be employed for access and deactivating all types of sprinkler heads. Any invention disclosed by this specification is defined by the claims.

The invention claimed is:

1. An apparatus for deactivating sprinkler heads comprising:

(a) a two staged forked clamping arm;
  a jaw arm with a stopper plug;
    wherein the forked clamping arm is positioned around a body of a fire-sprinkler and the stopper plug is squeezed against an outlet of the fire-sprinkler via locking plier action between the clamping member and the jaw arm member, wherein the stopper plug is ovular;
  a body handle member,
  a lever handle member,
  a strut member, and
  a release handle;

(b) the clamping arm is coupled to a front portion of the body handle member via a pin and obliquely extends therefrom said body handle member;

(c) the jaw arm is pivotally connected to (1) another front portion of the body handle member via another pin and (2) a front portion of the lever handle member via yet another pin;

(d) the body and lever handle members are pivotally connected to each other in view of their interconnection with the jaw arm;

(e) an end of the strut member is pivotally coupled at one of its ends to a mid-point of the lever handle via yet still another pin;

(f) and opposite end of the strut member is received within the body handle and rests atop a screw, which is threadably received through a butt of the body handle member;

(g) when the body handle member is moved towards the lever handle, or vice versa, the strut member causes the upper end of the lever handle member to move upwardly and outwardly, thereby causing the jaw arm to pivot about the pin in the handle arm member and move toward the clamping arm;

(h) by rotating the screw in a clockwise direction the portion of the screw within body handle member is lengthened to cause the jaw arm to be located closer to the clamping arm when the lever and body handle members are in a closed position (i) rotating screw in the opposite direction has the opposite effect;

(j) the lever and body handle members are preferably adapted to lock in the closed position when a centerline of lever handle member passes over a centerline of the strut member; and, (k) the release lever is provided to the lever handle member for prying the handle member away from a center locked engagement with the strut member.

* * * * *